US005143162A

United States Patent [19]

Lyon et al.

[11] Patent Number: 5,143,162

[45] Date of Patent: Sep. 1, 1992

[54] DEVICE FOR REMOVING DEBRIS FROM A DRILLHOLE

[75] Inventors: Leland H. Lyon; Ernest C. Hinck, both of Roanoke, Va.

[73] Assignee: Ingersoll-Rand Company, Woodcliff Lake, N.J.

[21] Appl. No.: 766,866

[22] Filed: Sep. 27, 1991

[51] Int. Cl.[5] ..... E21B 4/00

[52] U.S. Cl. ..... 175/100; 175/296; 175/324

[58] Field of Search ..... 175/58, 65, 68, 69, 175/107, 213, 232, 234, 242, 296, 300, 308, 309

[56] References Cited

U.S. PATENT DOCUMENTS

| | | | |
|---|---|---|---|
| 2,920,872 | 1/1960 | Baur et al. | 175/324 |
| 2,937,619 | 5/1960 | Kurt . | |
| 3,045,768 | 7/1962 | Huffman | 175/100 |
| 3,416,613 | 12/1968 | Henderson | 175/296 |
| 3,667,555 | 6/1972 | Elenburg | 175/100 X |
| 3,899,033 | 8/1975 | Van Huisen | 175/69 X |
| 4,084,646 | 4/1978 | Kurt | 173/17 |
| 4,436,166 | 3/1984 | Hayatdavoudi et al. | 175/324 X |
| 4,475,603 | 10/1984 | Hayatdavoudi | 175/65 |
| 4,488,607 | 12/1984 | Hayatdavoudi et al. | 175/65 |
| 4,688,650 | 8/1987 | Hayatdavoudi et al. | 175/324 |
| 4,694,911 | 9/1987 | Kennedy | 175/70 X |
| 4,974,690 | 12/1990 | Flynn | 175/317 |

*Primary Examiner*—Ramon S. Britts
*Assistant Examiner*—Roger J. Schoeppel
*Attorney, Agent, or Firm*—John J. Selko

[57] ABSTRACT

A device for use adjacent to a down-the-hole percussive drillhead, for removing debris from a drillhole, includes a separator for removing water and other matter from the percussive fluid prior to the percussive fluid entering the drillhead. The water and other matter are ejected into the drillhole to remove the debris, and the separator includes a one-way flow valve to prevent backflow of debris and water into the drillhead during periods when the percussive fluid flow ceases.

11 Claims, 2 Drawing Sheets

DEVICE FOR REMOVING DEBRIS FROM A DRILLHOLE

BACKGROUND OF THE INVENTION

This invention relates generally to rock drills and more particularly to pneumatically operated percussive drills of the type adapted to be inserted into the drillhole being drilled thereby and commonly known as "down-the-hole" drills (DHD).

Many applications for down-the-hole drills require that fluids such as water and other matter be injected into the drill air supply to provide improved hole cleaning and stabilization. Typically, the volume of liquids injected can range from about 2.0 gallons per minute to about 15.0 gallons per minute. When water is injected into the air flow for a DHD, an appreciable loss in penetration rate results for a given pressure. The decrease in penetration rate can range from 30% to 60%, depending upon the fluid injection rate and pressure. The loss in hammer performance associated with fluid injection adversely affects DHD production and in many cases causes the use of DHD to be unsuitable.

The foregoing illustrates limitations known to exist in present down-the-hole drilling technology. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a device for removing debris from a drillhole including a cyclonic separator positioned adjacent a top end of a percussion drilling tool for receiving a flow of a mixture of percussive fluid and other matter from a drill string axial bore. The separator removes and collects substantially all of the other matter from the percussive fluid and thereafter transmits the percussive fluid through the separator to the tool, while simultaneously transmitting the collected other matter and at least some of the percussive fluid out of the separator into the drillhole annulus, for removing debris. A one-way flow valve on the separator seals the separator against backflow of debris into the separator, when flow of percussive fluid ceases.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
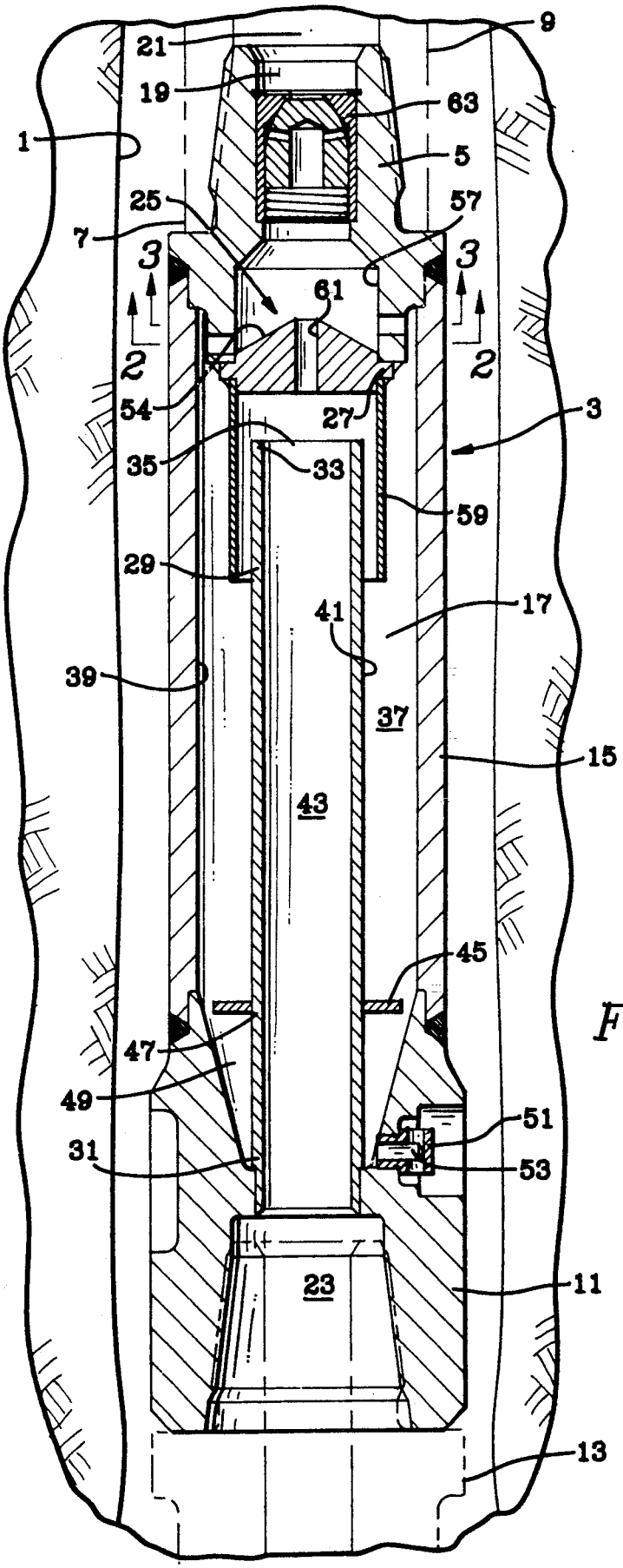
FIG. 1 is longitudinal section of a cleaning device for use with a fluid-activated, percussion, down-the-hole drill tool.

Referring to FIG. 1 there is shown a drillhole 1, having a drillhole cleaning device of this invention, shown generally as 3, positioned therein. Cleaning device 3 has a top connector 5 connected by conventional means, such threads, to the bottom end 7 of a drill string 9. A bottom connector 11 connects device 3, by conventional means, such as threads, to the back head of a down-the-hole drill 13. Equivalently, bottom connector 11 could connect to another member in a drillstring 9, rather than drill 13, so long as device 3 is within the drillhole 1 and adjacent to drill 13.

As is well known, a fluid is caused to flow through drill string 9 to activate drill 13. In this instance, drill 13 is of the type known as a percussive down-the-hole drill activated by a pneumatic fluid, such as air. Eventually, the fluid exits the drillhead and moves up the drillhole to carry out debris from drilling. Debris from drilling can include particles of strata being drilled, water seeping into the drillhole, plus other matter introduced into the drill 13 via the drillstring 9.

In order to increase debris removal, water may be injected into the fluid. Other matter, such as oil, may be injected for lubrication of the tool head. In addition, other matter, such as particles of rust or scale dislodged from the drill string interior may be carried by the fluid. Thus, the percussive fluid may be a mixture of air, water, oil, and other matter, including solid particles.

As used herein, the term "percussive" refers to the type of drill that utilizes a reciprocating piston to impart impact forces to a drillhead to cause penetration of the strata, and does not refer to a rotary type drill that utilizes a rotary grinding action to cause penetration.

Also, as used herein, the term "percussive fluid" refers to the pneumatic fluid that imparts the reciprocating action to the drill piston.

A longitudinal casing 15 is fastened, as by welding, to top connector 5 and bottom connector 11, and defines a hollow vortex chamber 17 extending axially therebetween. A first inlet 19 at top connector 5 fluidly communicates axially between drill string axial bore 21 and vortex chamber 17. A first outlet 23 at bottom connector 11 fluidly communicates axially between vortex chamber 17 and backhead 13.

Figure 2:
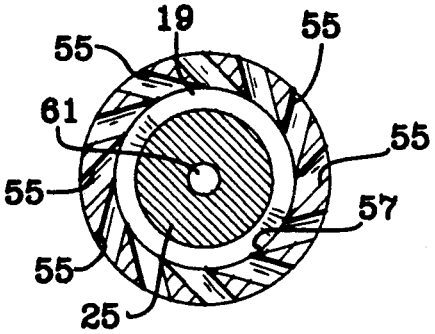
FIG. 2 is a horizontal cross sectional view taken along lines 2—2 of FIG. 1.
Figure 3:
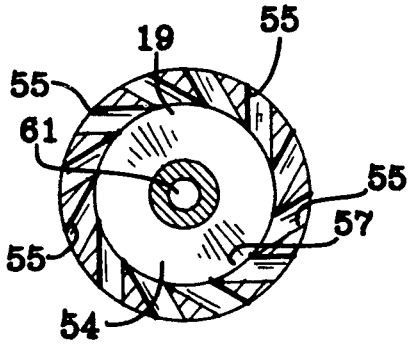
FIG. 3 is a horizontal cross sectional view taken along lines 3—3 of FIG. 1.

A deflector means, shown generally as 25, is sealingly fastened in first inlet 19. As shown in FIGS. 2 and 3, in horizontal cross section, inlet 19 is circular in outline, as is deflector means 25, although other shapes of outline could be used. Deflector means 25 further comprises a deflector plate 27 extending across first inlet 19, in a plane that is transverse to, and perpendicular to, the longitudinal axial direction of vortex chamber 17 and bore 21. This plane of deflector plate 27 is referred to herein as a "radial" plane or direction. Deflector means 25 deflects flow of a mixture percussive fluid and other matter from a downward axial direction to a radial and tangential direction, as hereinafter described.

A hollow focus tube 29 below deflector means 25 extends axially through vortex chamber 17 and has a lower end 31 sealingly in contact with bottom connector 11, and an upper end 33 terminating adjacent deflector means 25 in a focus tube inlet 35. Focus tube 29 defines a first percussive fluid passageway 37 between inner surface 39 of casing 15 and outer surface 41 of focus tube 29. Focus tube 29 also defines a second percussive fluid passageway 43 within focus tube 29 communicating axially between vortex chamber 17 and first outlet 23.

A baffle 45 is connected to the lower end 47 of focus tube 29 and extends annularly inwardly into first percussive fluid passageway 37 and ends spaced from inner surface 39, to cause reversal of flow of percussive fluid as described hereinafter.

A collection gallery 49 is formed below baffle 45 in lower end 47 of vortex chamber 17, for collecting other matter separated from the percussive fluid, as hereinafter described. A collection gallery outlet 51 communicates between the drillhole bore and the inside of collection gallery 49 to permit flow of other matter collected therein, plus some of the percussive fluid out into the annulus of the borehole 1. Outlet 51 can be a simple "T" shaped nipple having open passageways 53 therethrough. Although one outlet 51 is shown, a plurality of outlets, spaced circumferentially around vortex chamber 17 may be used.

Referring now to deflector means 25, deflector plate 27 has a cone shaped upper surface 54 extending axially upwardly within first inlet 19. As shown in FIGS. 2 and 3, connector 5 has a plurality of apertures 55 therethrough. Apertures 55 extend in a radial direction with respect to the axial direction of chamber 17. Inlet 19, is circular in outline as viewed in horizontal cross section, and apertures 55 extend tangentially with respect to the inner surface 57 of inlet 19. Apertures 55 communicate fluidly between first inlet 19 and first fluid passageway 37. Sealingly suspended downwardly from plate 27 is a hollow shield tube 59 telescoped axially over focus tube inlet 35, and extending a sufficient distance to prevent entry of the percussive fluid mixture into focus tube inlet 35 until after the percussive fluid mixture has passed downwardly the length of vortex chamber 17 and reversed direction at baffle 45. A single aperture 61 extends axially downwardly through plate 27 to form a passageway communicating between first inlet 19 and focus tube inlet 35 to permit at least some of the percussive fluid mixture to by-pass the deflector means, so as to permit a small amount of percussive fluid mixture to flow directly to the drill tool head for a purpose such as lubrication. It would be equivalent to provide a plurality of apertures instead of single aperture 61.

Figure 4:
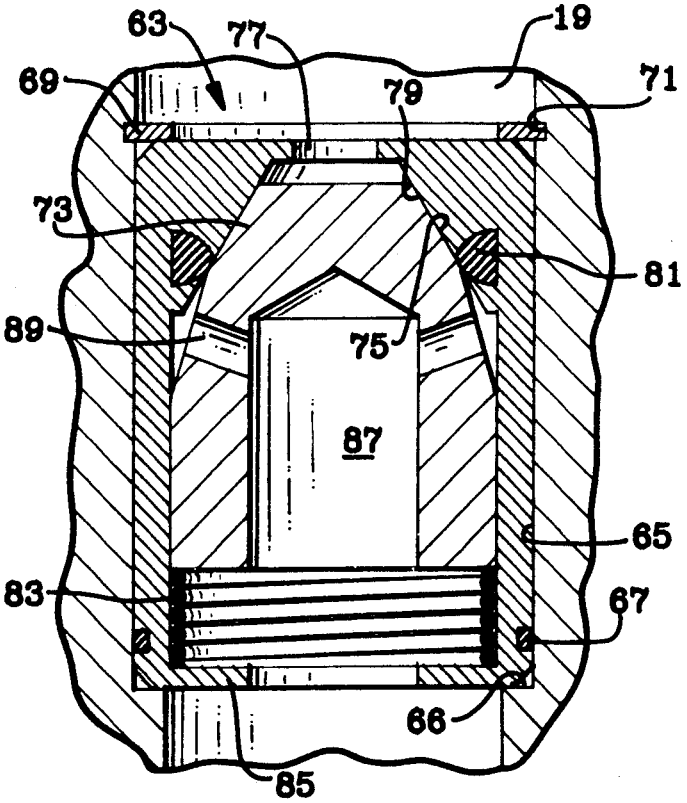
FIG. 4 is a longitudinal section of a one-way valve suitable for the invention, with portions removed.

Sealingly positioned in first inlet 19 is a one-way flow valve 63 adapted for permitting only downward axial flow of the percussive fluid mixture therethrough. During flow of percussive fluid, valve 63 is normally open. When flow of percussive fluid ceases, valve 63 closes. The need for valve 63 is because water and other debris from the borehole annulus backflows into the collection chamber 49 via open passageways 53, when fluid flow ceases. Such backflow accumulates in chamber 17, and would rise up to the focus tube inlet 35 and thence flow into the drill tool, to perhaps cause later damage when the drill starts operation again. With valve 63 closed, percussive fluid is trapped inside cleaning device 3, and as water and debris rise inside vortex chamber 17, the percussive fluid becomes compressed until its pressure equals the backflow pressure, and backflow ceases. Any conventional one-way valve will suffice. FIG. 4 shows one embodiment of such valve.

Referring to FIG. 4, one-way valve 63 includes a hollow tubular body 65, removably positioned on shoulder 66 in first inlet 19. Annular elastic seal 67 positioned in a groove in outer surface of body 65 sealingly contacts inner surface 57 of inlet 19. Body 65 is retained in place by retainer ring 69 positioned in matching groove 71, as is well known. Slidably positioned within hollow body 65 is hollow valve stem 73. Valve stem 73 has a truncated conical upper end 75 extending axially upwardly toward axial inlet aperture 77 in body 65. Body 65 has seal seat 79 sloped downwardly therein, shaped to conform to conical upper end 75. Positioned in seat surface 79 is elastic seal means 81 for alternate sealing and unsealing against upper end 75, as described hereinafter. Annular elastic spring means 83 seated against bottom flange 85 of body 65 contacts bottom end of stem 73, and urges stem 73 upwardly, so as to cause upper end 75 to sealingly contact seat surface 79 and seal 81. Thus, valve 63 is normally closed to percussive fluid flow. Inside stem 73 is hollow inlet chamber 87 that communicates axially with vortex chamber 17. A plurality of fluid passageways 89 extend through the wall of stem 73. Passageways 89 are spaced around the perimeter of conical surface 75. In operation, percussive fluid acts upon upper surface 75 to cause stem 73 to move axially downwardly and lose sealing contact with seal 81, thereby opening up a fluid passageway between axial bore 21, inlet 77 and inlet chamber 87, via passageways 89. When percussive fluid pressure is zero, as when the drill is inoperative, spring 83 urges stem 73 into sealing engagement with seat 79, thereby closing valve 63. The elastic property of spring 83 is preferably selected so that with a residual percussive fluid pressure greater that zero, and equal to, but not greater than the pressure inside vortex chamber 17, with an inoperative drill, the valve will remain closed.

In operation, the mixture of percussive fluid and other matter flows axially downwardly into first inlet 19, through valve 63 and against upper surface 54 where it is deflected to a tangential and radial outward direction into vortex chamber 17, to impact tangentially against inner surface 39 of casing 15. Thereafter, the percussive fluid mixture flows downwardly and circularly, in a vortex fashion, through first percussive fluid passageway 37 of vortex chamber 17, causing separation of at least some of the other matter from the percussive fluid mixture Such separated matter flows downward along inner surface 39 of casing 15 to collection chamber 49. At the lower end of chamber 17, the percussive fluid mixture strikes baffle 45, reverses its flow to an upward direction, causing separation of more of the other matter from percussive fluid mixture, and collection thereof in collection gallery 49. The percussive fluid, with substantially all of the other matter now removed, flows upwardly along the outer surface 41 of focus tube 29 toward focus tube inlet 35; thereafter down second fluid passageway 43, through outlet 23, into the backhead 13 of the drill tool, and thence therethrough to the drillhole bore, as is conventional.

In operation, the device of this invention has caused removal of a substantial amount of the other matter from the percussive fluid mixture, including water, oil and solid particles from the drill string interior. Such removal has resulted in dramatically improved penetration rate over those achieved without the removal of such other matter, while at the same time retained the benefits of debris removal due to the presence of the other matter in the bore of the drillhole. While this invention has been illustrated and described in accordance with a preferred embodiment, it is recognized that other variations and changes may be made therein without departing from the invention as set forth in the claims.

Having described the invention, what is claimed is:

1. A device for removing debris from a drillhole, said drillhole being made by a fluid-activated, percussion, down-the-hole drill tool, said tool adapted to be suspended at its top end from a drill string having an axial bore, comprising:

(a) inlet means for fluidly communicating with said drill string axial bore and for receiving a flow of a mixture of gaseous percussive fluid and other matter from said drill string axial bore;

(b) separator means positioned adjacent said top end of said tool for receiving a flow of a mixture of gaseous percussive fluid and other matter from said drill spring axial bore, for separating into phases and collecting in a bottom end of said separator means substantially all of said other matter from said gaseous percussive fluid and for thereafter transmitting said percussive fluid through said device to said tool, while simultaneously transmitting said collected other matter and at least some of said percussive fluid out of said separator means into the drillhole annulus, for removing said debris.

2. The invention of claim 1 in which said gaseous percussive fluid is air.

3. The invention of claim 2 in which said other matter is substantially all water.

4. The invention of claim 3 in which said other matter is a mixture of solid particles from the axial bore of said drill string and water.

5. The invention of claim 4 in which said other matter is a mixture of solid particle from the axial bore of said drill string, oil and water.

6. A device for removing debris from a drillhole, said drillhole being made by a fluid-activated, percussion, down-the-hole drill tool, said tool adapted to be suspended at its top end from a drill string having an axial bore, comprising:

a) separator means positioned adjacent said top end of said tool for receiving a flow of a mixture of gaseous percussive fluid and other matter from said drill string axial bore, for separating into phases and collecting in a bottom end of said separator means substantially all of said other matter from said gaseous percussive fluid and for thereafter transmitting said gaseous percussive fluid through said device to said tool, while simultaneously transmitting said collected other matter and at least some of said gaseous percussive fluid out of said separator means into the drillhole annulus, for removing said debris; and b) passageway means extending through said separator means for communicating between said drill string axial bore and said top end of said tool for permitting at least some of a percussive fluid mixture to by-pass said deflector means.

7. A device for removing debris from a drillhole, said drillhole being made by a fluid-activated, percussion, down-the-hole drill tool, said tool adapted to be suspended at its top end from a drill string having an axial bore, comprising:

a) separator means positioned adjacent said top end of said tool for receiving a flow of a mixture of gaseous percussive fluid and other matter from said drill string axial bore, for separating into phases and collecting substantially all of said other matter from said gaseous percussive fluid and for thereafter transmitting said gaseous percussive fluid through said device to said tool, while simultaneously transmitting said collected other matter and at least some of said gaseous percussive fluid out of said separator means into the drillhole annulus, for removing said debris; and b) valve means on said separator means for sealing said separator means against backflow of debris into said separator means, when flow of said gaseous percussive fluid ceases.

8. A device for removing debris from a drillhole, said drillhole being made by a fluid-activated, percussion. down-the-hole drill tool, said tool adapted to be suspended at its top end from a drill string having an axial bore, comprising:

a) inlet means for fluidly communicating with said drill string axial bore and for receiving a flow of a mixture of gaseous percussive fluid and other matter from said drill string axial bore;

b) separator means fluidly communicating with said inlet means for separating into phases said other matter from said gaseous percussive fluid and for transmitting said gaseous percussive fluid through said device to said tool;

c) collector means adjacent a bottom end of said separator means, fluidly communicating with said separator means, for collecting said other matter:

d) first outlet means fluidly communicating with said top end of said tool for transmitting said gaseous percussive fluid from said separator means to said tool;

e) second outlet means on said collector means for transmitting said collected other matter and at least some of said gaseous percussive fluid out of said device and into the drillhole annulus, for removing debris therefrom and f) valve means on said separator means for sealing said separator means against backflow of debris into said separator means, when flow of said gaseous percussive fluid ceases.

9. A device for removing debris from a drillhole, said drillhole being made by a fluid-activated, percussion, down-the-hole drill tool, said tool adapted to be suspended at its top end from a drill string having an axial bore, comprising:

a) a top connector for connecting the device to a drill string;

b) a bottom connector for connecting the device to a backhead of said down-the-hole drill tool;

c) a longitudinal casing extending axially between the top connector and the bottom connector, defining a hollow vortex chamber;

d) a first inlet at the top connector, fluidly communicating axially between said drill string and said vortex chamber for receiving a mixture of gaseous percussive fluid and other matter from said drill string;

e) a first outlet at said bottom connector fluidly communicating axially between said vortex chamber and said backhead;

f) deflector means in said first inlet for deflecting flow of said gaseous percussive fluid mixture from a downward axial direction to a tangential outward direction, to cause said gaseous percussive fluid mixture to impact tangentially against an inner surface of said casing and thereafter to flow downwardly through said vortex chamber, causing separation into phases of at least some of said other matter from said percussive fluid;

g) a hollow focus tube below said deflector means, extending axially through said vortex chamber, having a lower end sealingly connected to said bottom connector and an upper end terminating adjacent said deflector means in a focus tube inlet, said focus tube defining a first gaseous percussive fluid passageway between said inner surface of said casing and an outer surface of said focus tube and a second gaseous percussive fluid passageway within said focus tube, said second gaseous percussive fluid passageway communicating axially between said vortex chamber and said first outlet;

h) a baffle connected to said lower end of said focus tube in said first gaseous percussive fluid passageway and spaced from said inner surface of said casing, for reversing downward flow of said gaseous percussive fluid mixture into an upward flow toward said focus tube inlet, causing separation phase of more of said other matter from said gaseous percussive fluid mixture, and forming therebelow a collection gallery for said other matter separated from said gaseous percussive fluid;

i) a collection gallery outlet, permitting flow of said other matter and at least some of said gaseous percussive fluid out of said collection gallery into the annulus of said drillhole, to cause removal of said debris and j) a one-way flow valve in said first inlet for permitting only downward axial flow of gaseous percussive fluid therethrough.

10. The invention of claim 9 in which said deflector means further comprises:

a) a deflection plate within said first inlet, said deflection plate sealingly connected to an inside surface of said first inlet, said deflection plate having a cone shaped upper surface extending axially upwardly within said first inlet;

b) a plurality of apertures through said deflection plate, said apertures, when viewed in horizontal cross section, being tangentially disposed with respect to said inside surface of said first inlet, said apertures forming a plurality of gaseous percussive fluid passageways communicating between said first inlet and said first gaseous percussive fluid passageway; and c) a hollow shield tube sealingly connected to said deflection plate, said shield tube extending axially downward below said deflection plate and telescoped over said focus tube inlet a sufficient distance to prevent entry of said percussive fluid mixture into said focus tube until after said percussive fluid mixture has passed through the length of said first gaseous percussive fluid passageway.

11. The invention of claim 10 in which said deflection plate has at least one aperture extending axially downwardly therethrough, to form a passageway communicating between said first inlet and said focus tube inlet to permit at least some of said percussive fluid mixture to by-pass said deflector means.

* * * * *